US008382053B2

(12) United States Patent
Webb

(10) Patent No.: US 8,382,053 B2
(45) Date of Patent: Feb. 26, 2013

(54) MODULAR BEVERAGE HOLDER

(76) Inventor: Brian Scott Webb, Tallahassee, FL (US)

( * ) Notice: Subject to any disclaimer, the term of this patent is extended or adjusted under 35 U.S.C. 154(b) by 0 days.

(21) Appl. No.: 12/942,243

(22) Filed: Nov. 9, 2010

(65) Prior Publication Data

US 2012/0112019 A1 May 10, 2012

(51) Int. Cl.
*A47K 1/08* (2006.01)

(52) U.S. Cl. ..... 248/311.2; 248/146

(58) Field of Classification Search ..... 248/311.2, 248/312.1, 309.1, 314, 315, 146
See application file for complete search history.

(56) References Cited

U.S. PATENT DOCUMENTS

| | | | | |
|---|---|---|---|---|
| 2,557,674 | A | 6/1951 | McRae | |
| 4,334,621 | A * | 6/1982 | Weber | 211/70.3 |
| 4,836,113 | A | 6/1989 | Waddell et al. | |
| 5,009,379 | A | 4/1991 | Sadler | |
| 5,022,626 | A * | 6/1991 | Nozel et al. | 248/311.2 |
| 5,038,434 | A | 8/1991 | Navarrette | |
| 5,605,235 | A | 2/1997 | Johnson | |
| 5,642,541 | A | 7/1997 | Corbin | |
| 5,651,152 | A | 7/1997 | Ritchie et al. | |
| 5,730,522 | A * | 3/1998 | Wyke et al. | 362/432 |
| 5,897,041 | A * | 4/1999 | Ney et al. | 224/483 |
| D444,706 | S * | 7/2001 | Giancaspro | D9/455 |
| 6,374,440 | B1 | 4/2002 | Thim, Jr. | |
| 6,820,523 | B1 * | 11/2004 | Chen | 81/177.2 |
| 7,207,450 | B1 * | 4/2007 | Franklin et al. | 211/205 |
| D550,981 | S | 9/2007 | Watson, Jr. | |
| 7,296,311 | B1 | 11/2007 | Navarrette | |
| D612,691 | S * | 3/2010 | Barnes, Jr. | D7/620 |
| D620,982 | S * | 8/2010 | Parshad | D19/81 |
| 2002/0130236 | A1 * | 9/2002 | Swensen | 248/315 |
| 2004/0261175 | A1 | 12/2004 | May | |
| 2009/0173862 | A1 * | 7/2009 | Lota | 248/311.2 |

* cited by examiner

*Primary Examiner* — Terrell McKinnon
*Assistant Examiner* — Steven Marsh
(74) *Attorney, Agent, or Firm* — J. Wiley Horton

(57) ABSTRACT

A beverage container holder adapted to hold a wide variety of containers including cups, bottles, mugs, and tumblers. The device preferably includes a base, an upright extending upward from the base, and a receiver near the top of the upright. The receiver includes a cup holder which is preferably made detachable so that it may be washed in a dishwasher. The cup holder and receiver include a cutout which is wide enough to accommodate the handle on a coffee cup.

12 Claims, 9 Drawing Sheets

MODULAR BEVERAGE HOLDER

BACKGROUND OF THE INVENTION

1. Field of the Invention

This invention relates to the field of beverage holders. More specifically, the present invention comprises a modular beverage holder which can accommodate a wide variety of containers.

2. Description of the Related Art

The need to provide a resting surface for beverage containers has long been recognized. The simplest solution to this problem is the provision of an end table (for a couch or chair) or a nightstand (for a bed). These pieces of furniture provide a horizontal surface near the user's position. The user may then place his or her beverage on this horizontal surface.

Of course, end tables and nightstands are relatively expensive and fixed in one location. Thus, some inventors have explored the possibility of a less expensive solution which may be attached directly to the furniture itself. An example of this approach is found in U.S. Pat. No. 4,836,113 to Waddell (1989). The Waddell device provides a flat tray adjacent to a bed frame. A similar approach is taken in U.S. Pat. No. D550, 981 to Watson (2007) and U.S. Pat. No. 5,038,434 to Navarrette (1991).

All these devices provide a flat resting surface adjacent to the user's position. However, they fail to secure the beverage container in position. They also fail to account for the fact that a beverage holder must be periodically cleaned to provide a sanitary condition. The present invention solves these and other problems, as will be described more particularly in the following text.

BRIEF SUMMARY OF THE INVENTION

The present invention comprises a beverage container holder adapted to hold a wide variety of containers including cups, bottles, mugs, and tumblers. The device preferably includes a base, an upright extending upward from the base, and a receiver near the top of the upright. The receiver includes a cup holder which is preferably made detachable so that it may be washed in a dishwasher.

The cup holder and receiver include a cutout which is wide enough to accommodate the handle on a coffee cup. Since the cutout on the receiver and the cutout in the cup holder are preferably maintained in alignment, those embodiments including a detachable cup holder are provided with a rotation-limiting connection between the cup holder and the receiver which maintains the alignment of the two cutouts.

REFERENCE NUMERALS IN THE DRAWINGS

| | |
|---|---|
| 10 | beverage stand |
| 12 | receiver |
| 14 | cup holder |
| 16 | base |
| 18 | upright |
| 20 | box spring |
| 22 | mattress |
| 24 | lip |
| 26 | holder cutout |
| 28 | receiver cutout |
| 30 | circular relief |
| 32 | notch |
| 34 | edge |
| 36 | step |
| 38 | small portion |
| 40 | large portion |
| 42 | coffee mug |
| 44 | handle |
| 46 | can |
| 48 | insulating jacket |
| 50 | upper surface |
| 52 | tumbler |
| 54 | notch |
| 56 | rib |

DETAILED DESCRIPTION OF THE INVENTION

Figure 1:
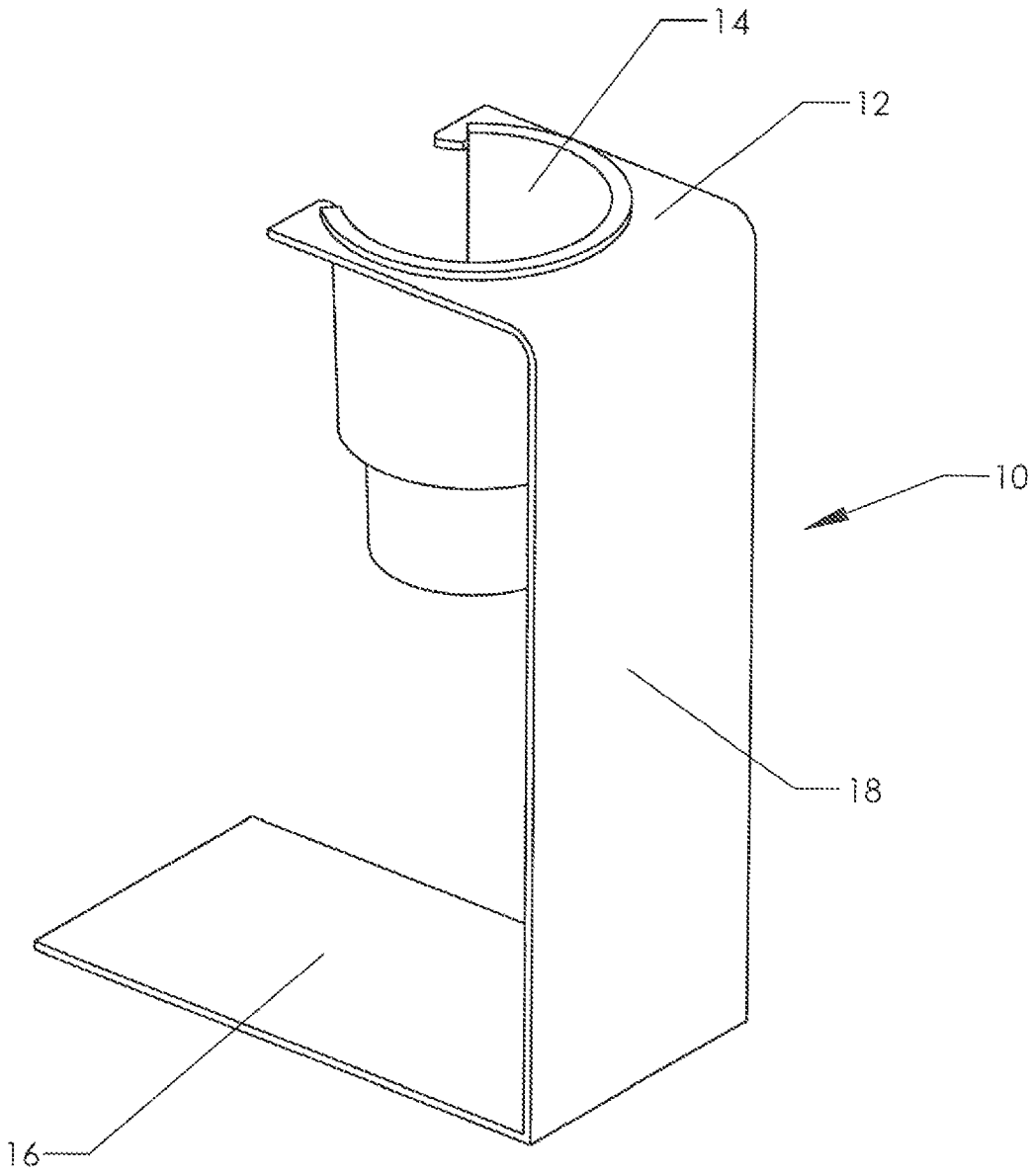
FIG. 1 is a perspective view, showing a preferred embodiment of the present invention.

The present invention provides a resting place for a beverage container when the user is not actually holding the beverage container. FIG. 1 shows a preferred embodiment. Beverage stand 10 includes base 16, upright 18, and receiver 12. Upright 18 extends upward from base 16 to any desired height. Receiver 12 is connected to the upper end of upright 18. Cup holder 14 is attached to receiver 12.

In some embodiments the cup holder is integral to the receiver itself. However, in the preferred embodiments the cup holder is made removable. The cup holder will accumulate small quantities of spilled liquid over time. The spilled liquid tarnishes the appearance of the device and may in some instances create an unsanitary hazard. Making the cup holder removable allows it to be more easily cleaned—such as by placing it in a dishwasher.

Figure 2:
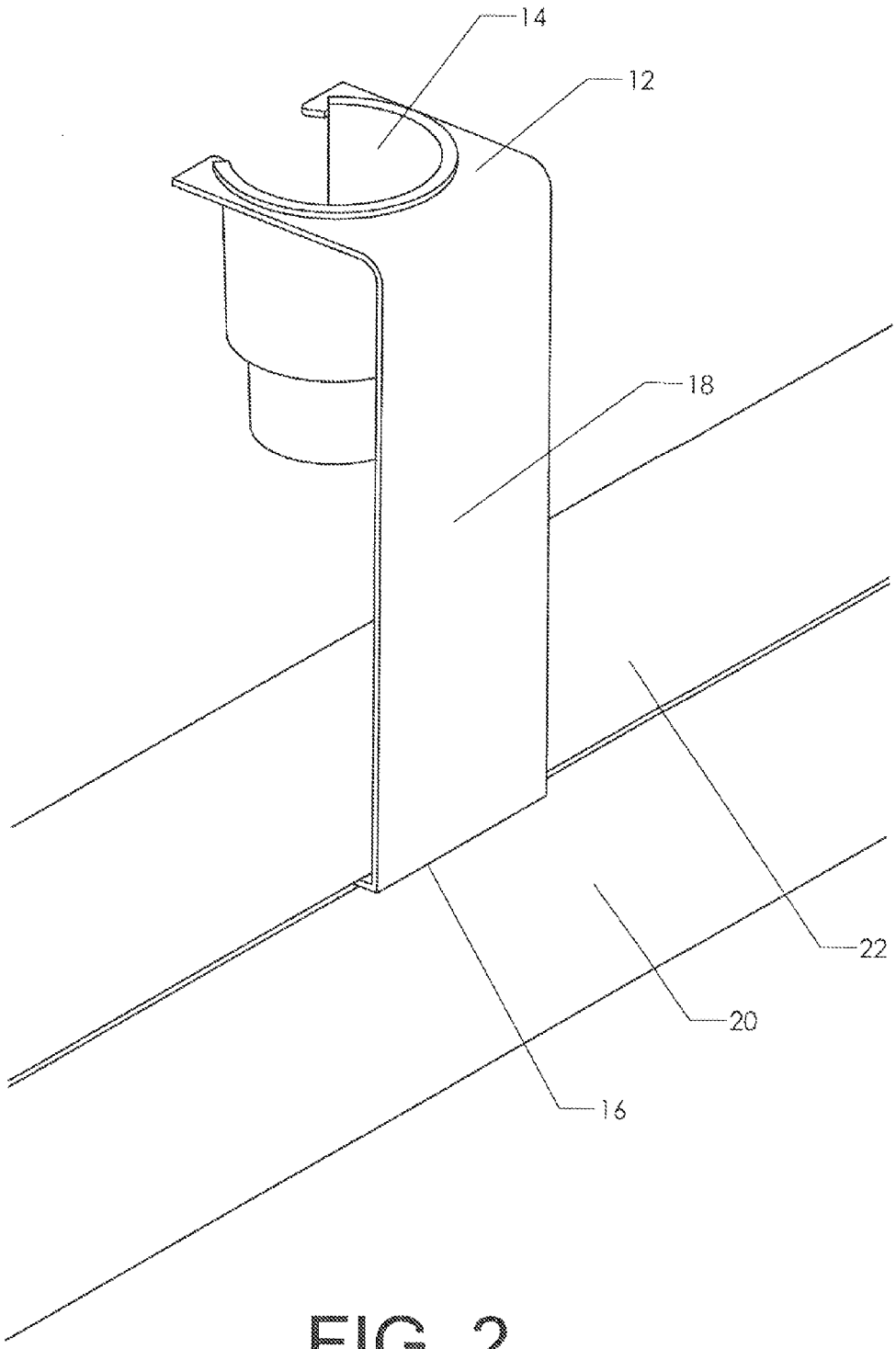
FIG. 2 is a perspective view, showing the embodiment of FIG. 1 attached to a bed.

In the embodiment of FIG. 1, base 16 is elongated so that it may be captured between two elements of a piece of furniture. As an example, FIG. 2 shows the stand with base 16 inserted between box spring 20 and mattress 22. Upright 18 is preferably made long enough to place receiver 12 well above the upper level of the mattress when the unit is installed. The same method may be used to secure the device to a couch or chair. In that scenario, base 16 is inserted between the cushion and the frame.

Figure 3:
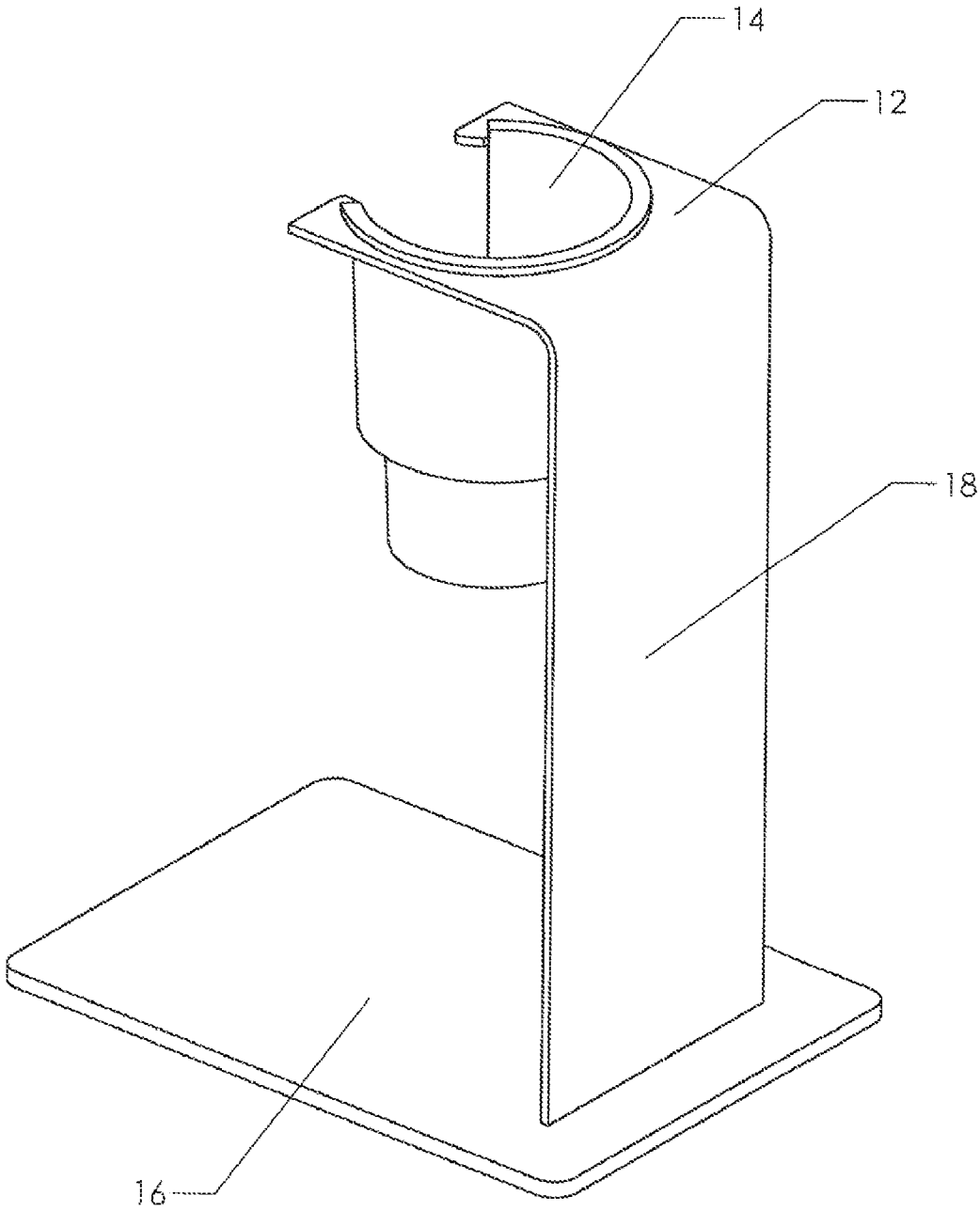
FIG. 3 is a perspective view of an alternate embodiment, including a larger base.

Other embodiments may be configured to rest directly on the floor. FIG. 3 shows an embodiment in which base 16 is enlarged in all directions so that it provides stable support when the unit is placed directly on the floor. Upright 18 is sized so that cup holder 14 will rest at the same height as an arm rest or side table.

Figure 4:
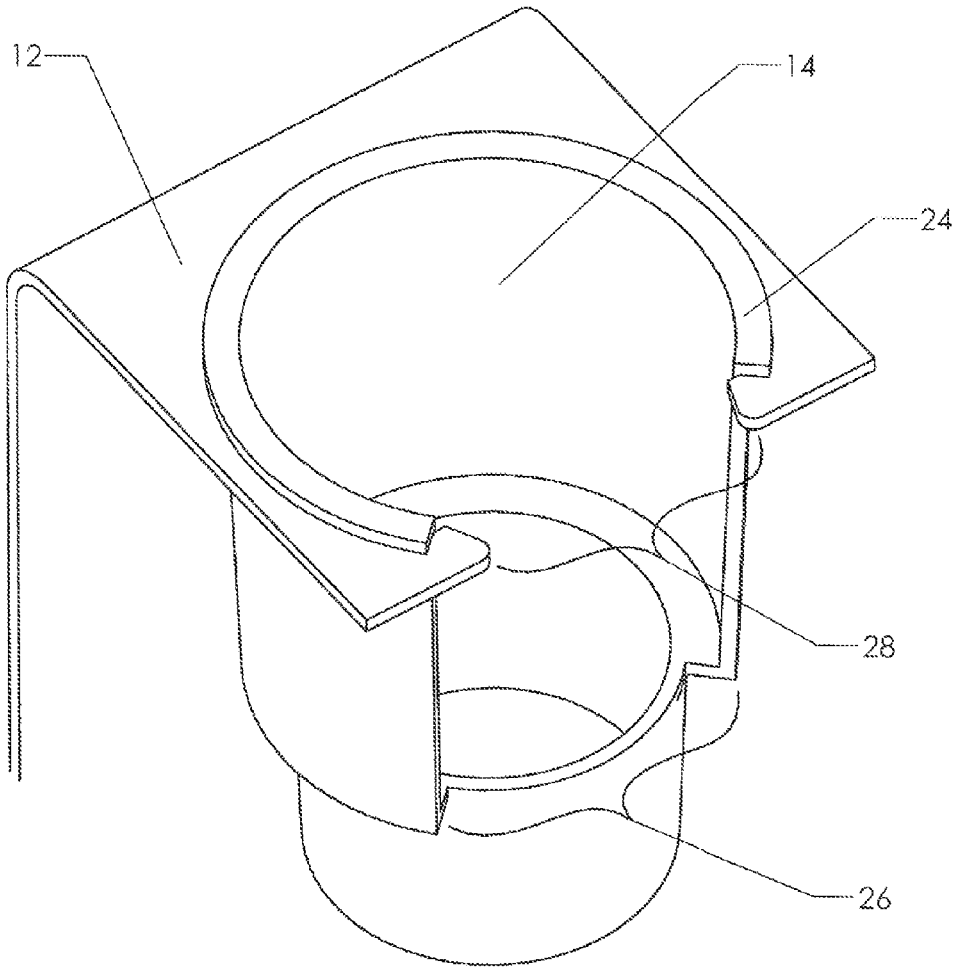
FIG. 4 is a detailed perspective view, showing the detachable cup holder in its receiver.

As stated previously, the preferred embodiments include a removable cup holder. FIG. 4 shows this configuration in more detail. Cup holder 14 is provided with lip 24 which extends over the upward facing surface of receiver 12. Thus, the cup holder may be lowered into position but it cannot pass completely through the receiver.

The cup holder includes a cutout sized to accommodate the handle of a coffee mug. Holder cutout 26 passes through the vertical side wall of cup holder 14. Receiver cutout 28 passes through the corresponding portion of receiver 12. It is preferable to provide a rotation-limiting connection between the cup holder and the receiver so that the two cutouts are aligned when the cup holder is placed in the receiver.

Figure 5:
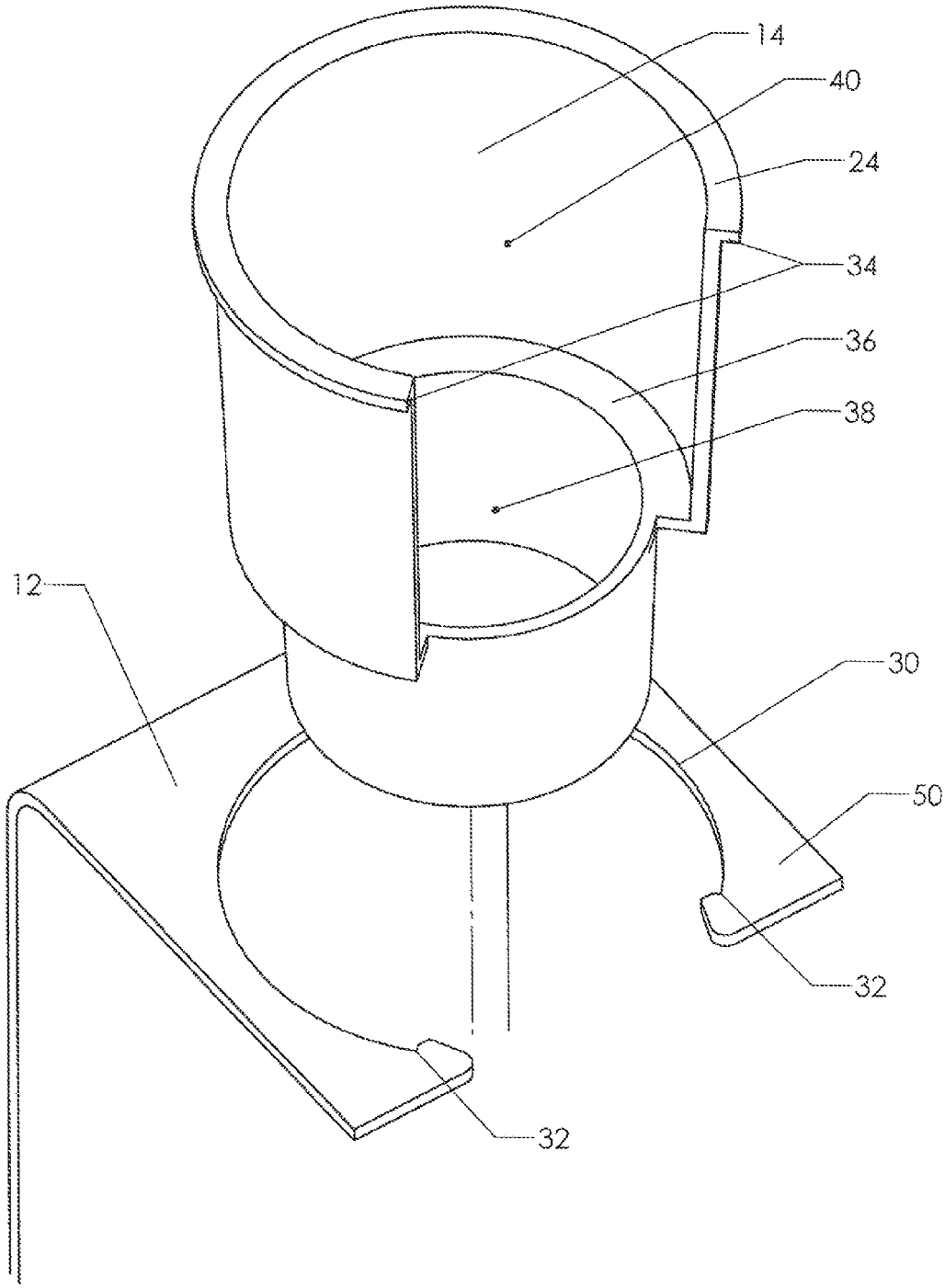
FIG. 5 is an exploded perspective view, showing the cup holder removed from the receiver.

The rotation-limiting connection may assume many forms. FIG. 5 shows an example of such a connection. Receiver 12 includes circular relief 30 which is sized to receiver large portion 40 of cup holder 14 without allowing lip 24 to pass through. The cup holder rests within circular relief 30 but lip 24 bears against upper surface 50. Circular relief 30 includes one or more notches 32 which are positioned to engage edges 34 on the cutout in the vertical side wall of the cup holder. Thus, when the cup holder is placed in the receiver, the cup holder is unable to rotate with respect to the receiver. In addition, the engagement of the notches with the two edges properly aligns the cutout in the cup holder with the cutout in the receiver.

The size and shape of the cup holder may assume many forms. FIG. 5 shows a version including large portion 40 and small portion 38. Step 36 lies at the junction between the large portion and the small portion. Step provides a horizontal surface which engages the bottom of a typical coffee mug. On the other hand, the base of a large tumbler will typically be small enough to pass beyond step 36 and into small portion 38.

Figure 6:
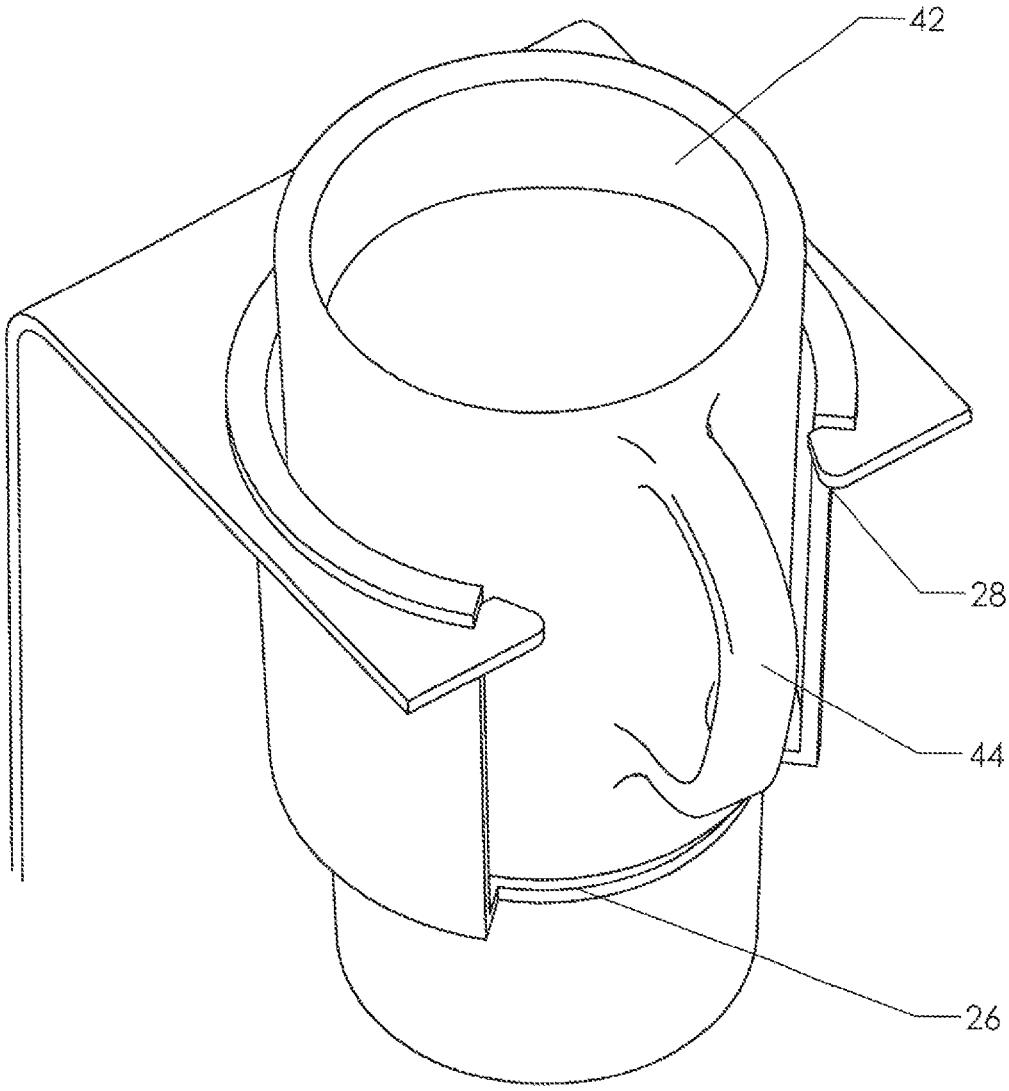
FIG. 6 is a detailed perspective view, showing a coffee cup retained by the cup holder.

FIG. 6 shows the same embodiment with coffee mug 42 in position within the cup holder. The reader will observe how handle 44 protrudes through holder cutout 26 and receiver cutout 28. The user may grasp the handle and use it to remove the mug from the cup holder or place the mug back in the cup holder. Sufficient clearance is preferably provided on each side of handle 44 to avoid interference between the cup holder and the user's thumb and fingers.

Figure 7:
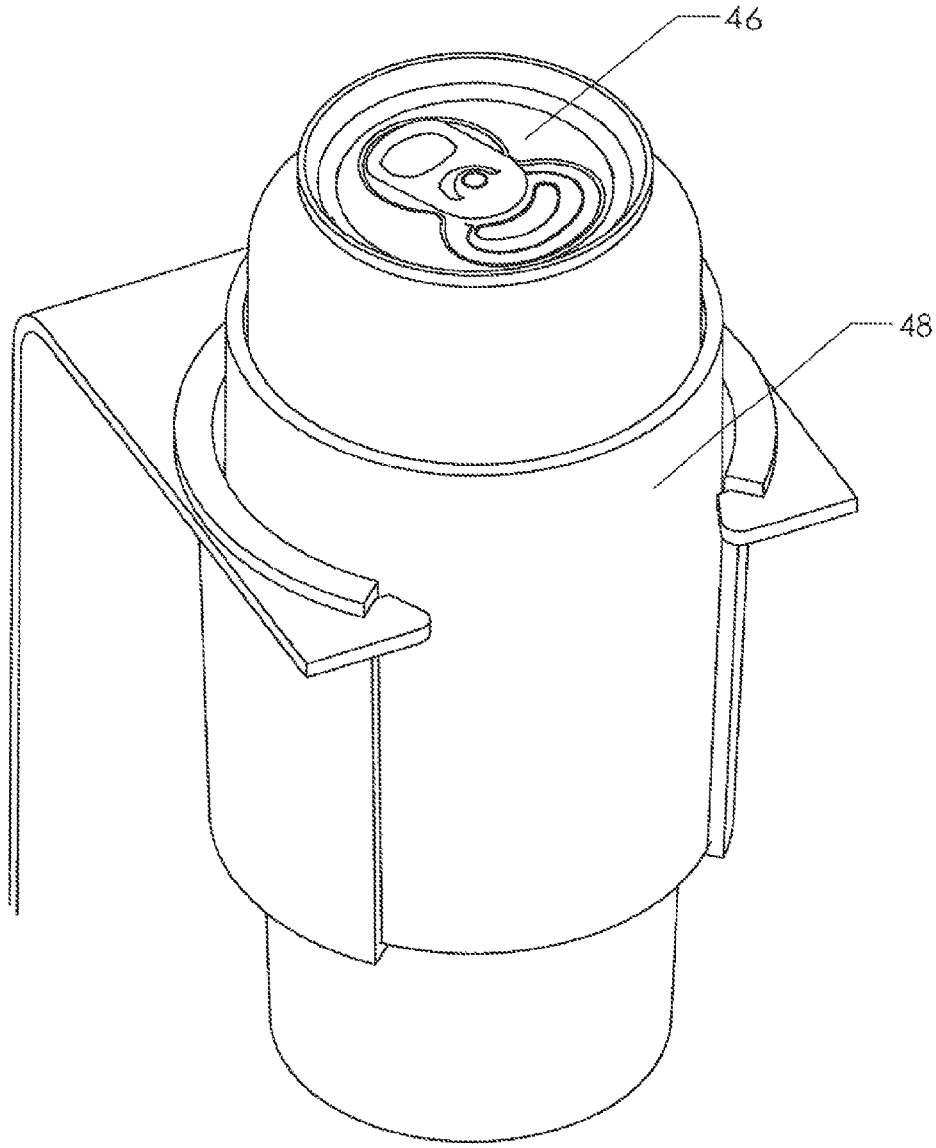
FIG. 7 is a detailed perspective view, showing a can retained by the cup holder.
Figure 8:
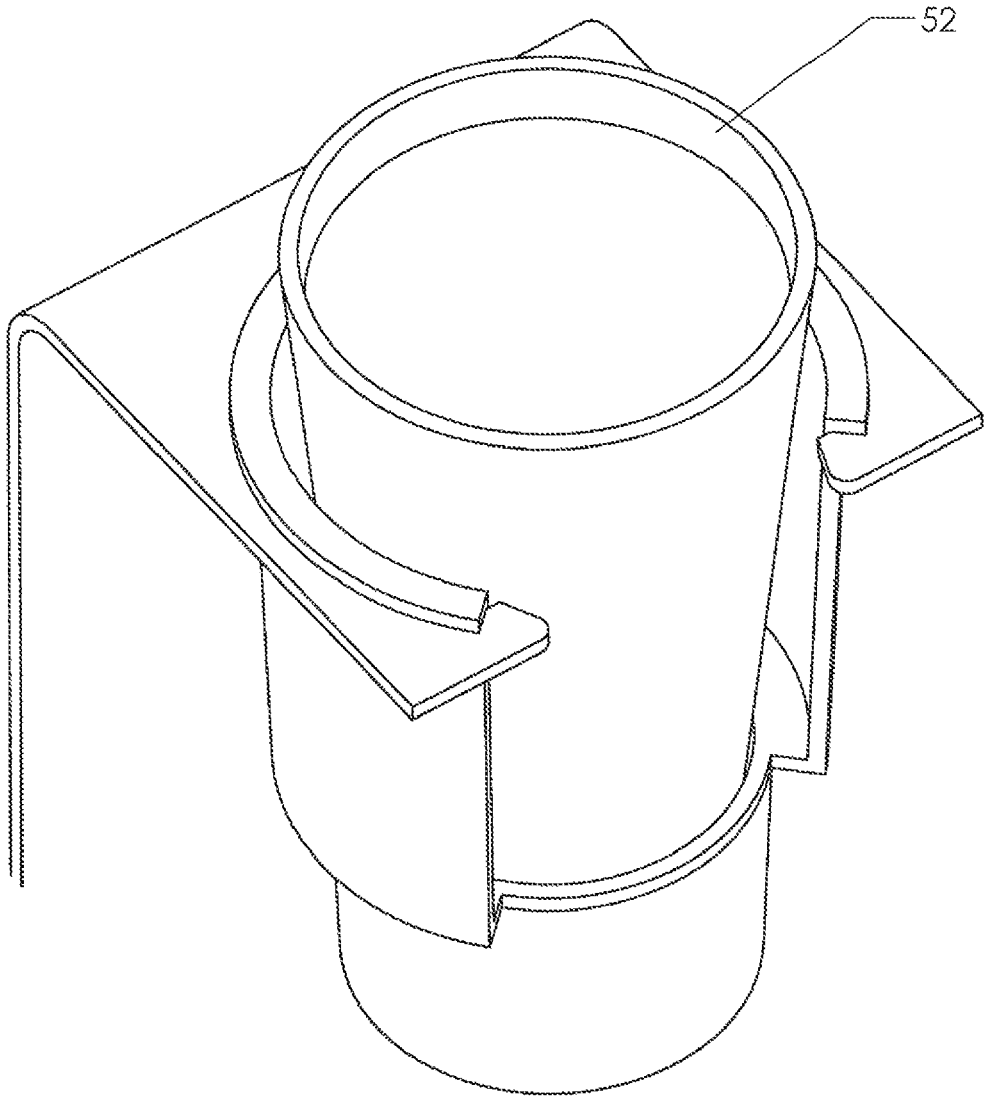
FIG. 8 is a detailed perspective view, showing a tumbler retained by the cup holder.

FIGS. 7 and 8 show how the same cup holder geometry can accommodate different types of beverage containers. FIG. 7 shows an aluminum can 46 surrounded by an insulating jacket 48. This fits within large portion 40 of the sup holder. FIG. 8 shows a large tumbler 52, the base of which is resting within the small portion of the cup holder.

Figure 9:
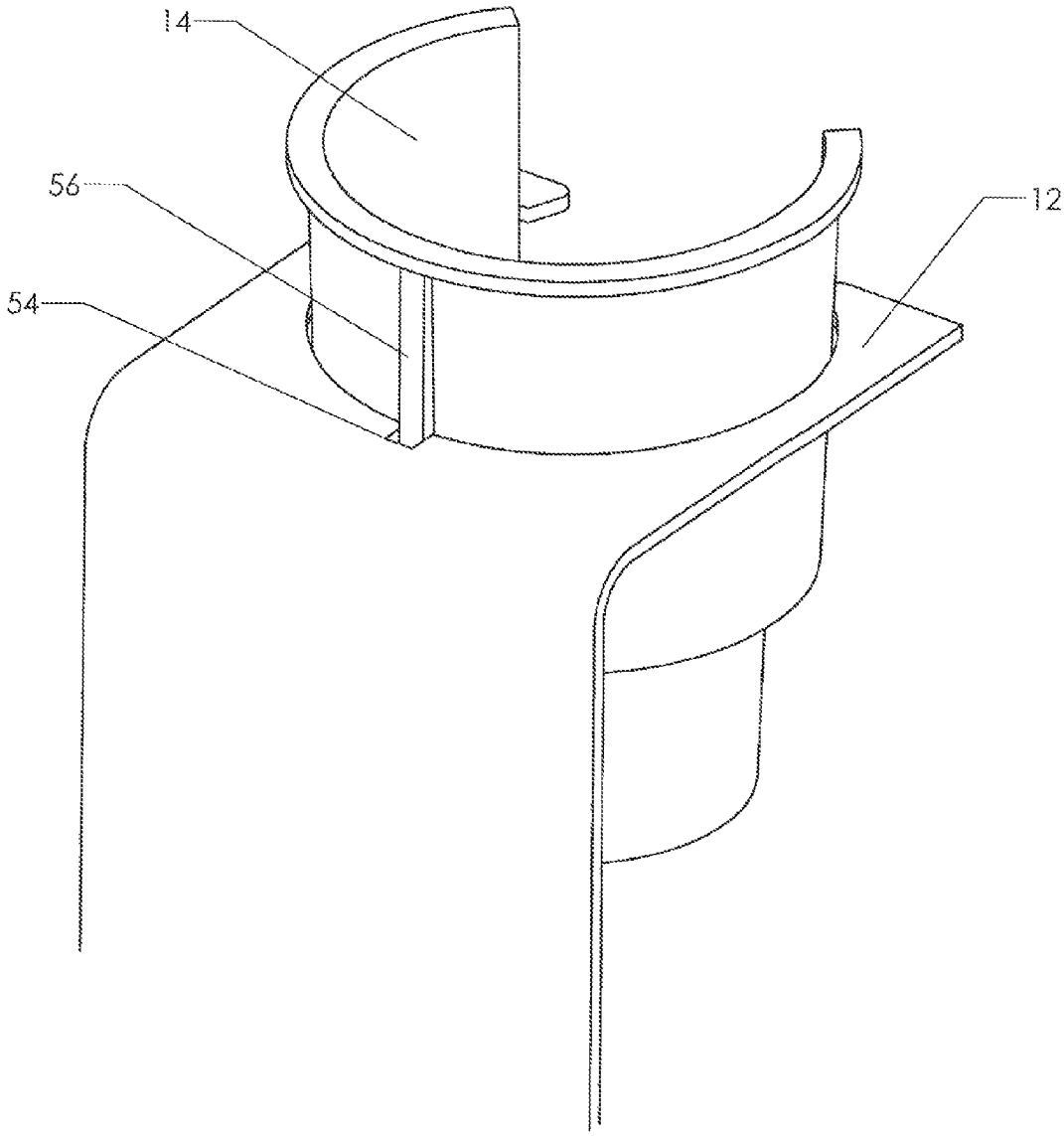
FIG. 9 is a detailed perspective view, showing an alternate embodiment of the cup holder and receiver.

FIG. 9 shows one possible additional embodiment for the preferred rotation-limiting connection between cup holder 14 and receiver 12. The cup holder has been provided with a vertical rib 56 sized to slide into notch 54 in the receiver. This engagement easily prevents rotation while maintaining the desired alignment between the cutouts in the cup holder and the receiver.

The invention can be made using a wide variety of materials and need not be made from any single material. As a first example, the base and upright might be made of stamped metal while the receiver and cup holder could be made of injection molded plastic. Likewise, the entire assembly could be made as one unitary piece.

The preceding description contains significant detail regarding the novel aspects of the present invention. It should not be construed, however, as limiting the scope of the invention but rather as providing illustrations of the preferred embodiments of the invention. As an example, although the illustrated embodiments show a design incorporating a removable cup holder, the invention could be made of glass and could feature an integral cup holder and receiver. Such variations would not alter the function of the invention. Thus, the scope of the invention should be fixed by the following claims, rather than by the examples given.

Having described my invention, I claim:

1. A beverage container holder for holding a mug including an outwardly protruding handle, comprising:

a. a base;

b. an upright extending from said base;

c. a receiver attached to said upright, said receiver having an upward facing surface;

d. a cup holder attached to said receiver, said cup holder having, i. a vertical side wall, having an upper extreme, ii. a lip extending outward from said upper extreme of said vertical side wall, with said lip resting atop said upward facing surface of said receiver, iii. a bottom, joining a lower extreme of said vertical side wall;

e. a holder cutout in said vertical side wall of said cup holder and said lip;

f. a receiver cutout in said receiver;

g. wherein said cup holder is removable from said receiver;

h. a mechanical interlock between said cup holder and said receiver that prohibits rotation between said cup holder and said receiver; and i. said mechanical interlock aligning said receiver cutout with said holder cutout so that said protruding handle passes through both said receiver cutout and said holder cutout when said mug is placed in said cup holder.

2. A beverage container holder as recited in claim 1, wherein said bottom of said cup holder is solid so that said cup holder can accumulate spilled liquids.

3. A beverage container holder as recited in claim 1 wherein said holder cutout and receiver cutout are wide enough to admit said handle and a thumb of a user on a first side of said handle and a finger of a user on a second side of said handle.

4. A beverage container holder as recited in claim 1, wherein said rotation-prohibiting mechanical interlock comprises a notch in said receiver engaging an edge of said cutout of said cup holder.

5. A beverage container holder as recited in claim 1, wherein said rotation-prohibiting mechanical interlock comprises a rib on said cup holder sliding into a notch in said receiver.

6. A beverage container holder as recited in claim 1, wherein said cup holder includes a large portion and a small portion.

7. A beverage container holder for holding a mug including an outwardly protruding handle, comprising:

a. a base;

b. an upright extending from said base;

c. a receiver attached to said upright, said receiver including a an upward facing surface, with a circular relief passing vertically through said upward facing surface;

d. a cylindrical cup holder sized to fit into said circular relief in said receiver, said cup holder having, i. a vertical side wall having an upper extreme, ii. a lip extending outward from said upper extreme of said vertical side wall, with said lip resting atop said upward facing surface of said receiver;

e. a holder cutout in said vertical side wall of said cup holder and said lip;

f. a receiver cutout in said receiver;

g. wherein said cup holder is removable from said receiver;

h. a mechanical interlock between said cup holder and said receiver that prohibits rotation between said cup holder and said receiver; and i. said mechanical interlock aligning said receiver cutout with said holder cutout so that said protruding handle passes through both said receiver cutout and said holder cutout when said mug is placed in said cup holder.

8. A beverage container holder as recited in claim 7, wherein said cup holder has a solid bottom configured to accumulate spilled liquids.

9. A beverage container holder as recited in claim 7, wherein said holder cutout and receiver cutout are wide enough to admit said handle and a thumb of a user on a first side of said handle and a finger of a user on a second side of said handle.

10. beverage container holder as recited in claim 7, wherein said rotation-prohibiting mechanical interlock comprises a notch in said receiver engaging an edge of said cutout of said cup holder.

11. A beverage container holder as recited in claim 7, wherein said rotation-prohibiting mechanical interlock comprises a rib on said cup holder sliding, into a notch in said receiver.

12. A beverage container holder as recited in claim 7, wherein said cup holder includes a large portion and a small portion.

* * * * *